US011774198B2

(12) United States Patent
Plebani et al.

(10) Patent No.: US 11,774,198 B2
(45) Date of Patent: Oct. 3, 2023

(54) RIFLE WITH RECOIL GROUP

(71) Applicant: FABBRICA D'ARMI PIETRO BERETTA S.P.A., Brescia (IT)

(72) Inventors: Ennio Plebani, Brescia (IT); Mauro Brugnani, Brescia (IT); Nunzia Longobardi, Brescia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 0 days.

(21) Appl. No.: 17/968,504

(22) Filed: Oct. 18, 2022

(65) Prior Publication Data

US 2023/0124825 A1 Apr. 20, 2023

(30) Foreign Application Priority Data

Oct. 18, 2021 (IT) ..... 102021000026654

(51) Int. Cl.
*F41A 3/20* (2006.01)
*F41A 3/82* (2006.01)
*F41A 3/72* (2006.01)

(52) U.S. Cl.
CPC *F41A 3/82* (2013.01); *F41A 3/20* (2013.01); *F41A 3/72* (2013.01)

(58) Field of Classification Search
CPC ..... F41A 3/20; F41A 3/22; F41A 3/24
See application file for complete search history.

(56) References Cited

U.S. PATENT DOCUMENTS

| | | | | |
|---|---|---|---|---|
| 1,322,053 | A | 11/1919 | Reising | |
| 3,710,495 | A | 1/1973 | Ziegler et al. | |
| 9,103,608 | B2 * | 8/2015 | Dumortier | F41A 3/12 |
| 10,514,219 | B2 | 12/2019 | Schafer | |
| 2020/0049436 | A1 | 2/2020 | Braceras Devecchi | |
| 2022/0299280 | A1 * | 9/2022 | Sunseri | F41A 3/46 |

FOREIGN PATENT DOCUMENTS

DE 10 2018 114 381 A1 12/2019

OTHER PUBLICATIONS

Italian Search Report for Italian Patent Application No. 102021000026654 dated May 31, 2022, 2 pages.

* cited by examiner

*Primary Examiner* — Reginald S Tillman, Jr.
(74) *Attorney, Agent, or Firm* — Merchant & Gould, P.C.

(57) ABSTRACT

A rifle has a fixed main body, including a barrel, a receiver with an upper opening, a breech element, and a trigger assembly at least partly accommodated in the receiver. The rifle has a slide assembly including a shutter group positioned on the receiver at the upper opening and axially movable by the user between an advanced shooting configuration and a retracted rearming configuration, and vice versa. The rifle includes a recoil group at least partially accommodated in the receiver, for cooperating with the slide assembly having a thrust device with a thrust lever, which is rotationally movable and a thrust spring, which performs torsional action on the thrust lever. The thrust lever extends between a lever upper end and a lever lower end. The lever upper end is suitable engageable with the advancing slide assembly to push it into the advanced configuration.

19 Claims, 13 Drawing Sheets

RIFLE WITH RECOIL GROUP

This application claims the benefit of Serial No. 102021000026654, filed 18 Oct. 2021 in Italy and which application is incorporated herein by reference. To the extent appropriate, a claim of priority is made to the above disclosed application.

BACKGROUND OF THE INVENTION

The present invention relates to a rifle.

In particular, the present invention relates to a rifle preferably, but not necessarily, for hunting.

In still further detail, the rifle object of the present invention is of the type in which the rearming operations are performed by the user by axially manually moving the slide assembly.

In the prior art, rifles with the aforementioned features and operating modes are known.

In particular, embodiments of rifles are known which comprise a fixed main body grippable by the user, and a slide assembly manually movable by the user to rearm the round. In particular, it is known in such rifles to move the slide assembly between an advanced configuration and a retracted configuration and vice versa. Preferably, such known rifle solutions comprise a rearming trigger, or rearming lever, grippable by the user to carry out the aforesaid operations.

SUMMARY OF THE INVENTION

The object of the present invention is to provide an alternative rifle solution to the known solutions of the prior art. In particular, the rifle solution which is the object of the present invention has a slide assembly suitable for sliding on the receiver in such a way as to open it at the top in the entirety thereof, while at the same time ensuring a predetermined, replicable and safe advanced shooting configuration.

BRIEF DESCRIPTION OF THE DRAWINGS

In addition, further features and advantages of the invention will become clear from the description provided below of the preferred embodiments thereof given as non-limiting examples in reference to the accompanying figures, in which:

FIGS. 1*a*' and 1*b*' show side views of the rifle shown in FIGS. 1*a* and 1*b;*

FIG. 3' is a side view of the rifle of FIG. 3 in a partial sectional view;

FIG. 5' is a side view of the rifle of FIG. 5 in a partial sectional view;

DETAILED DESCRIPTION OF THE PREFERRED EMBODIMENT

Figures 1A, 1B:
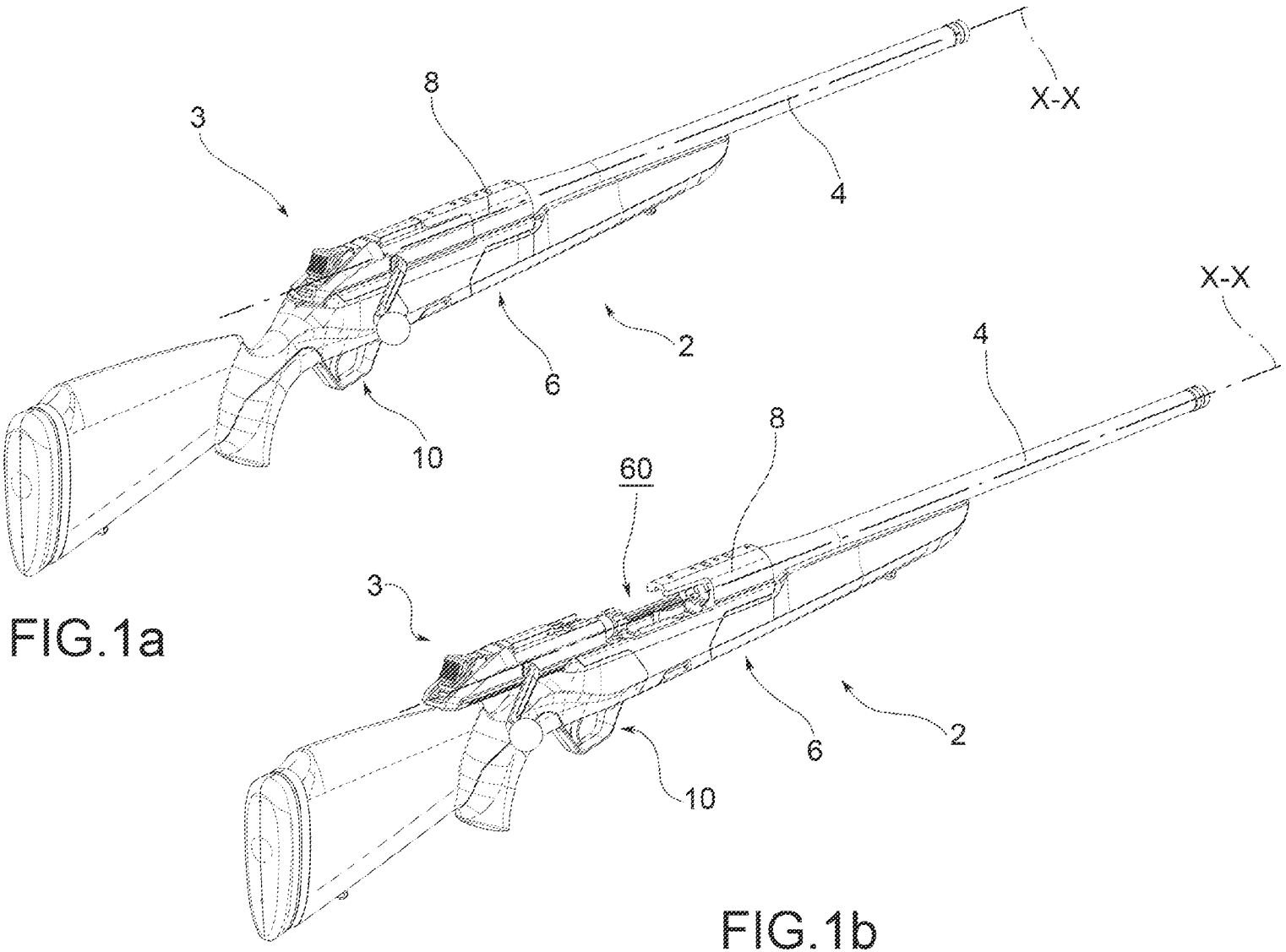
FIGS. 1*a* and 1*b* show, in perspective views, a rifle according to the present invention, wherein the slide assembly included therein, according to a preferred embodiment, is in an advanced shooting configuration and in a retracted rearming configuration;)
Figure 1A:
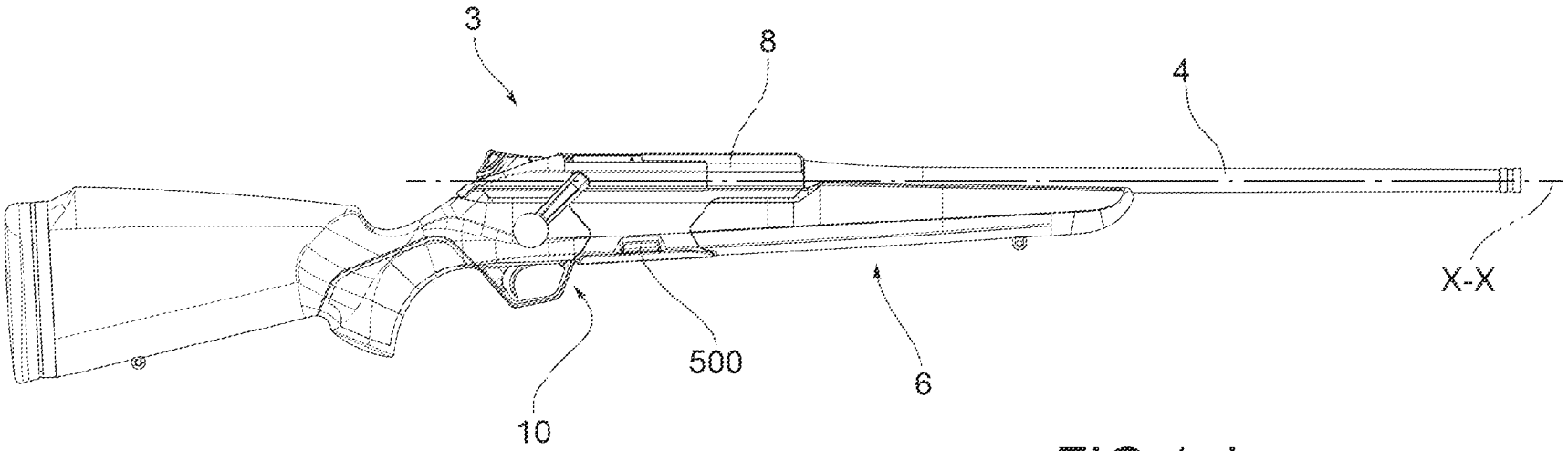
Figure 1B:
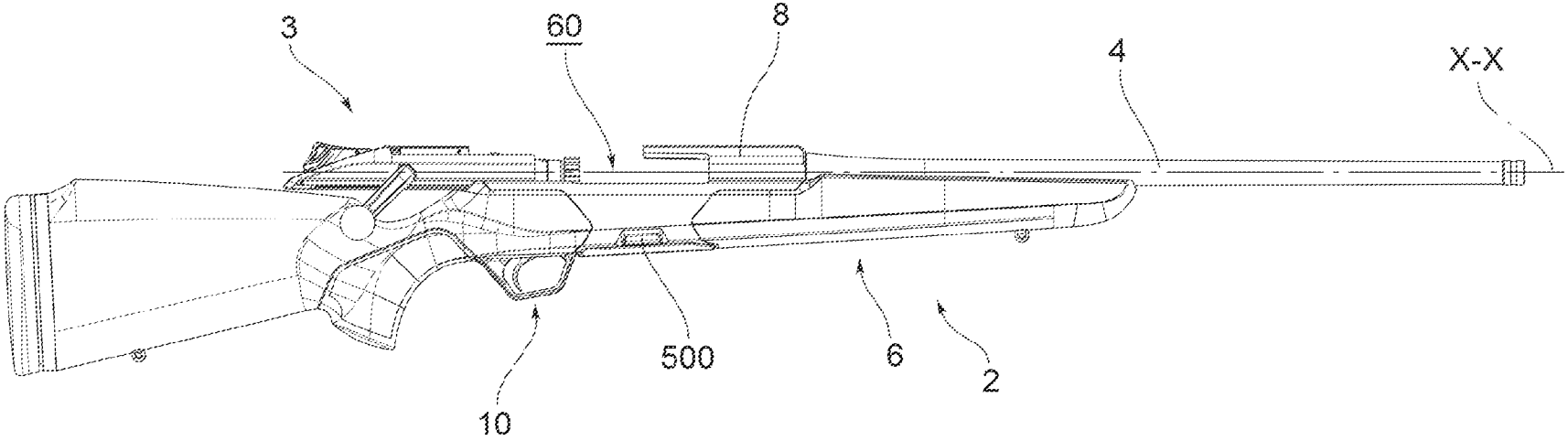
Figure 1:
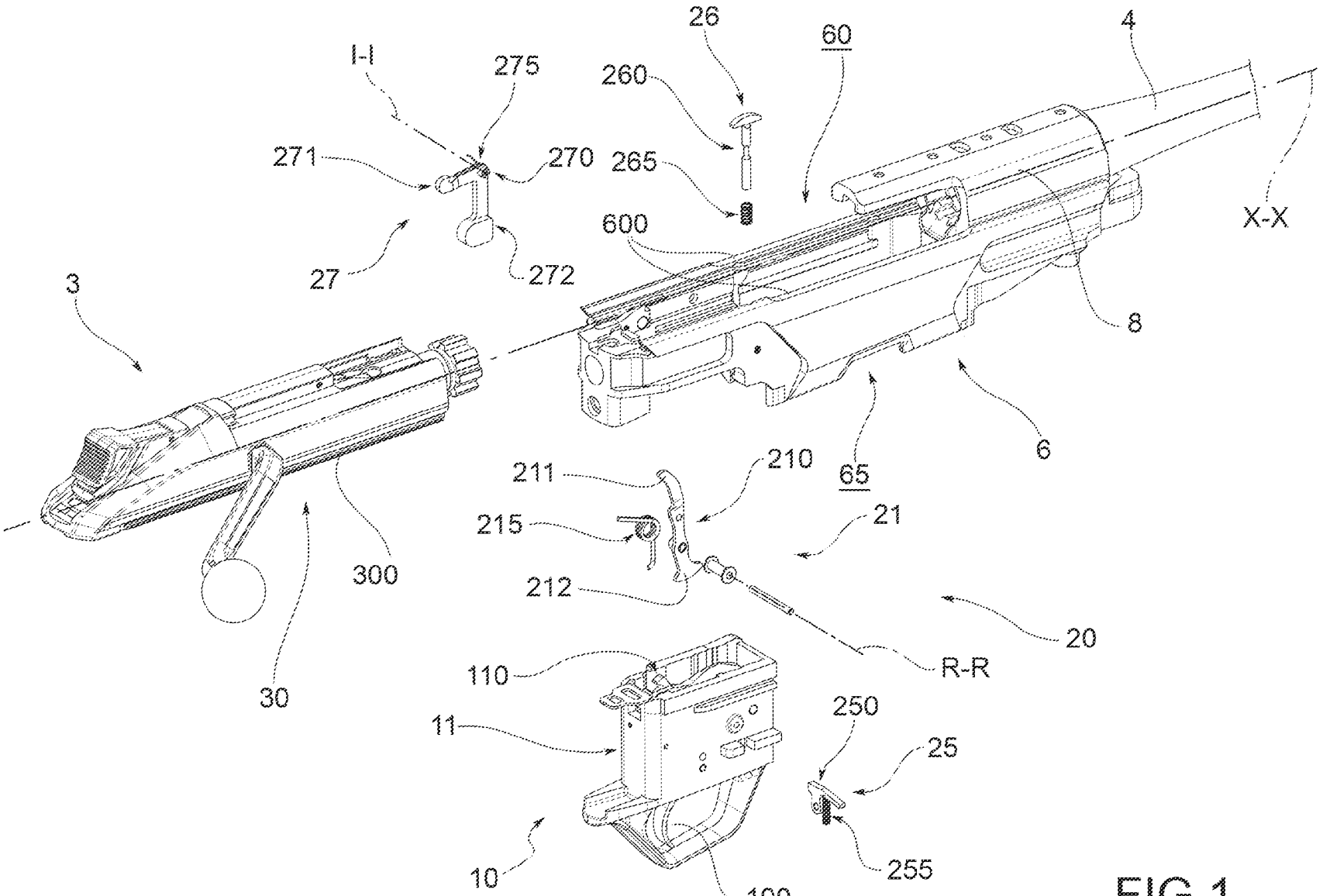
FIG. 1 is a perspective view with separate parts of some components included in the rifle of FIGS. 1*a* and 1*b;*
Figure 2:
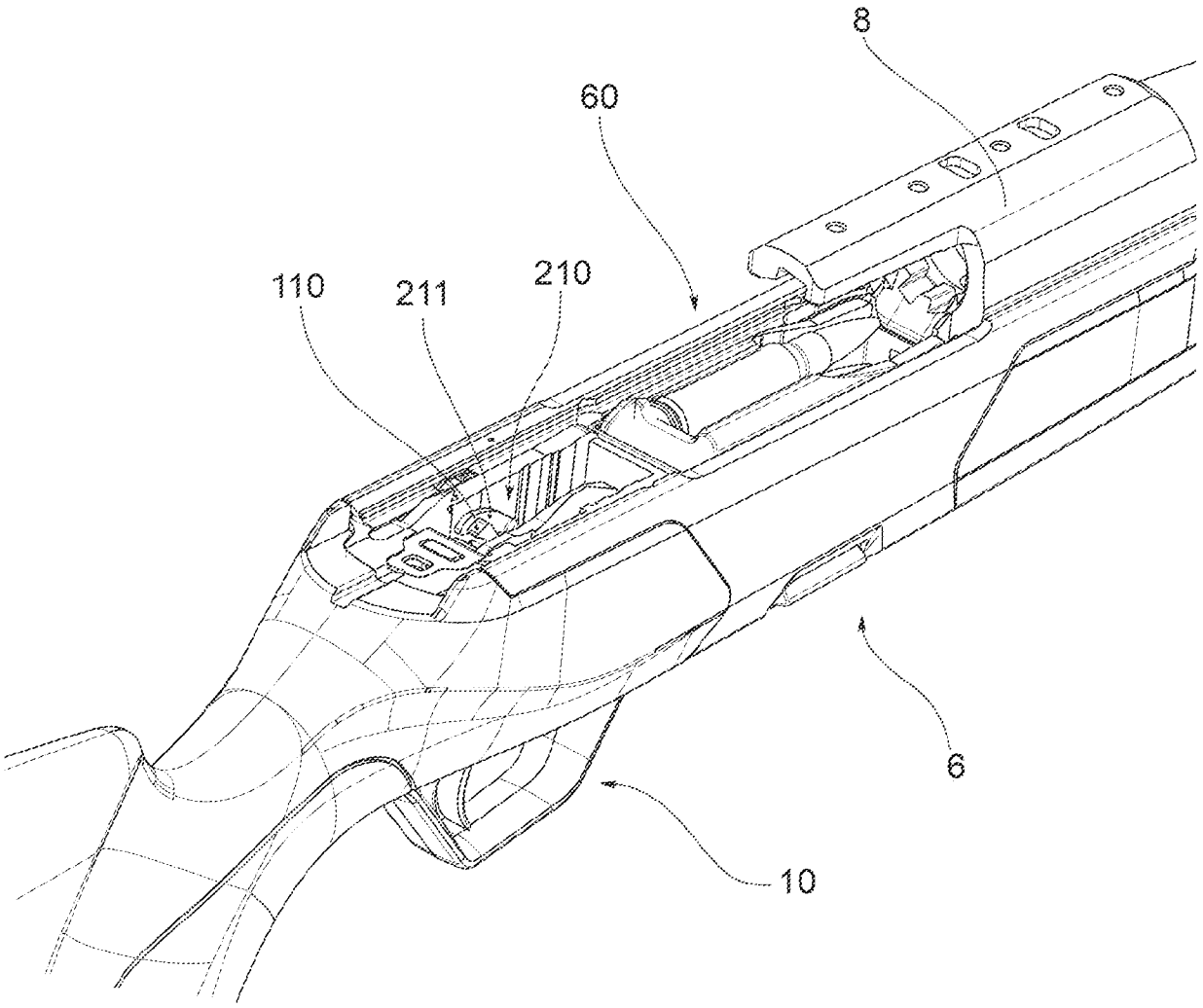
FIG. 2 shows a partial perspective view of the rifle wherein the slide assembly is disassembled from the receiver.
Figure 2B:
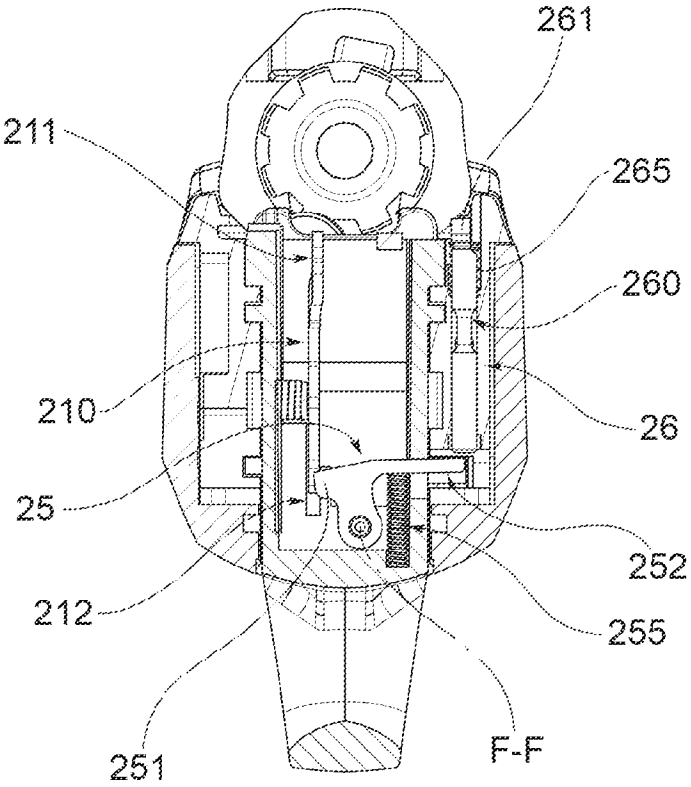
FIGS. 2*a* and 2*b* are two longitudinal sectional and cross-sectional views, respectively, of the rifle, without the slide assembly, of FIG. 2.
Figure 2A:
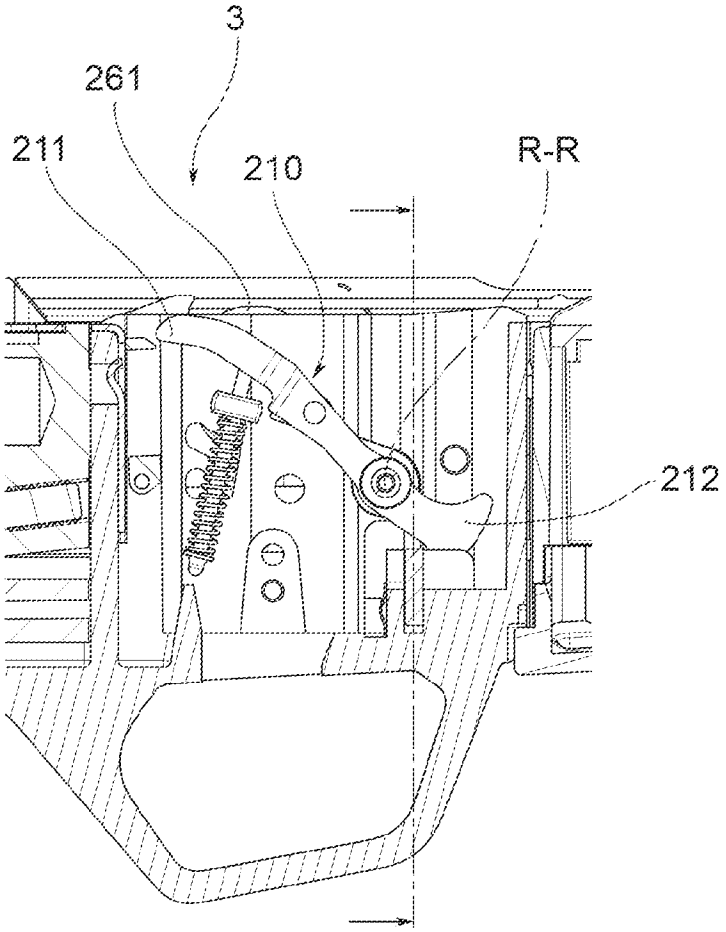
Figure 3:
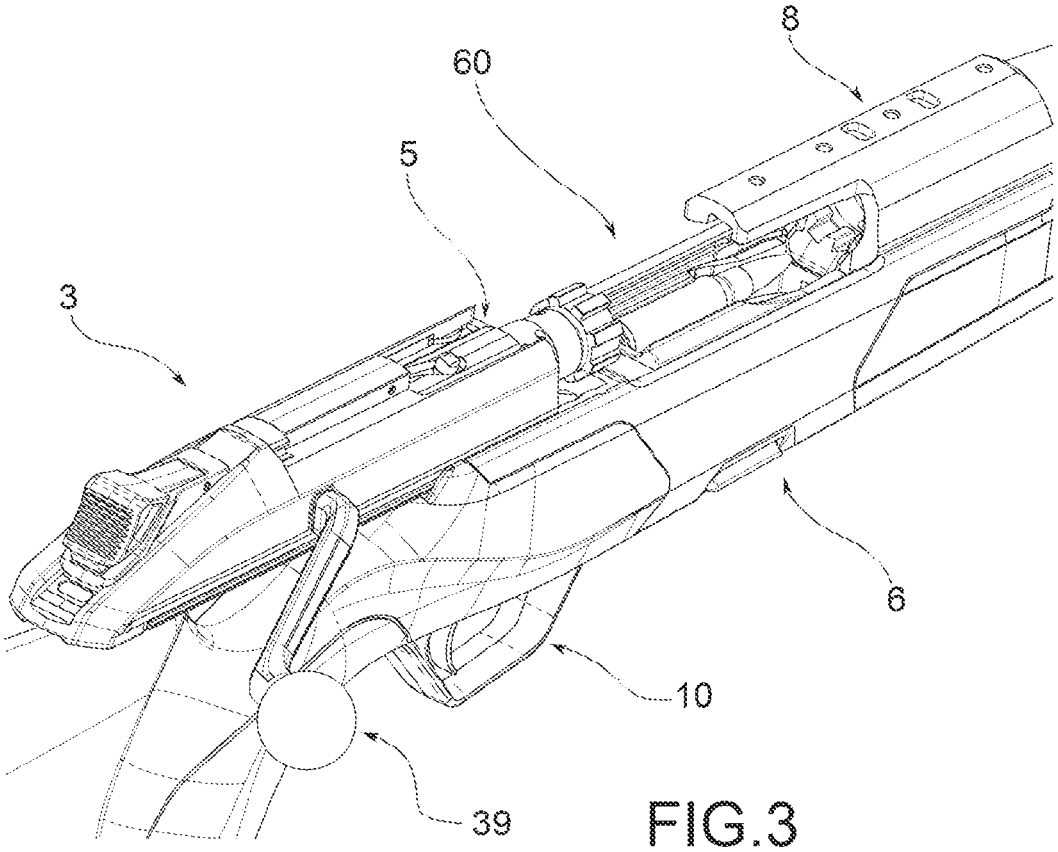
FIG. 3 shows a partial perspective view of the rifle wherein the slide assembly is in a retracted configuration.
Figure 3:
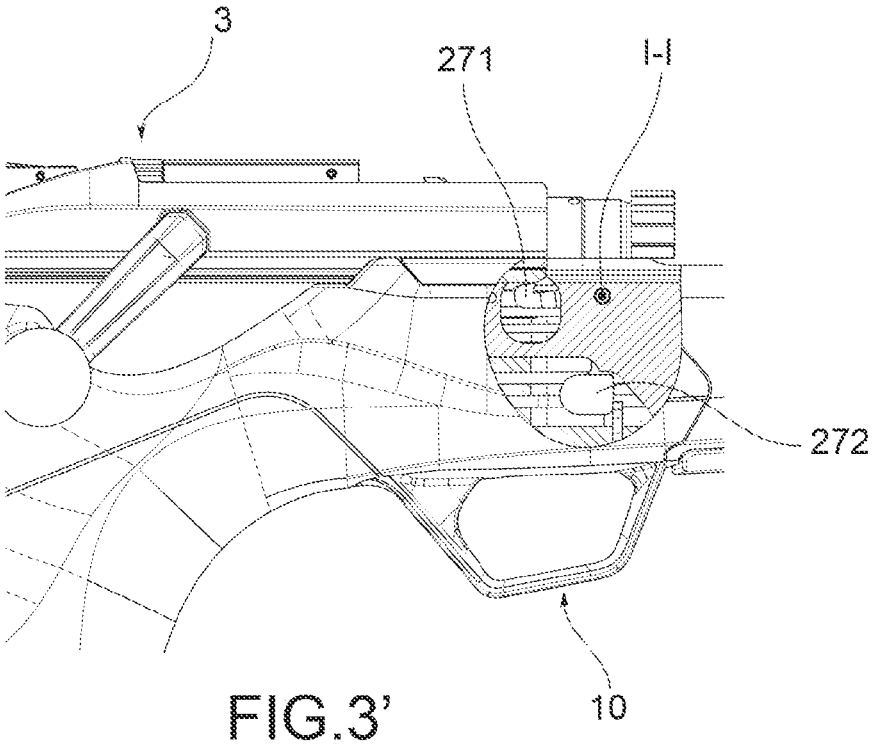
Figure 3B:
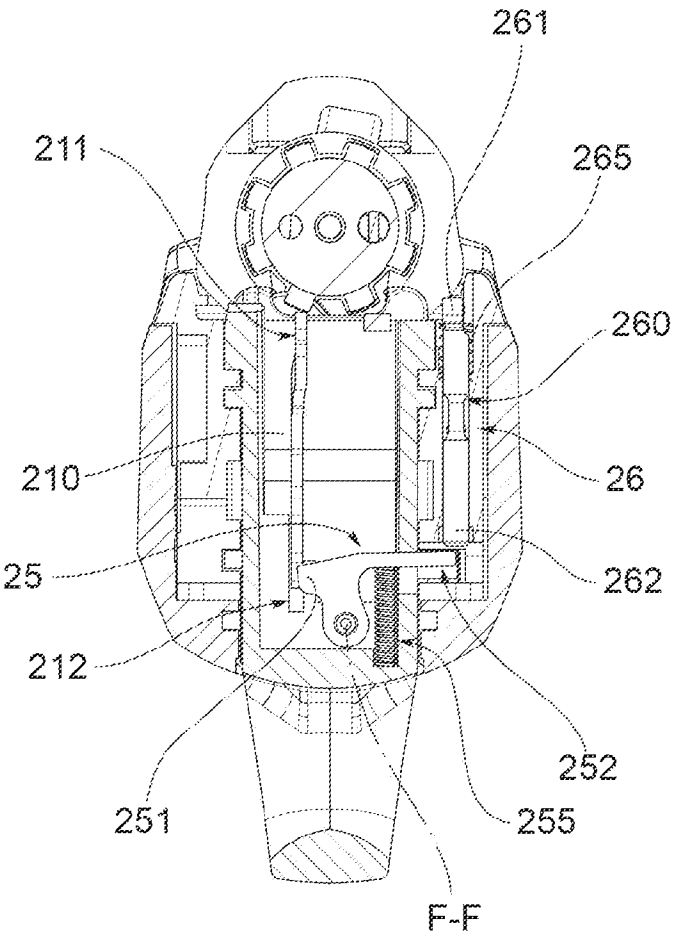
FIGS. 3*a* and 3*b* are two longitudinal sectional and cross-sectional views, respectively, of the rifle of FIG. 3.
Figure 3A:
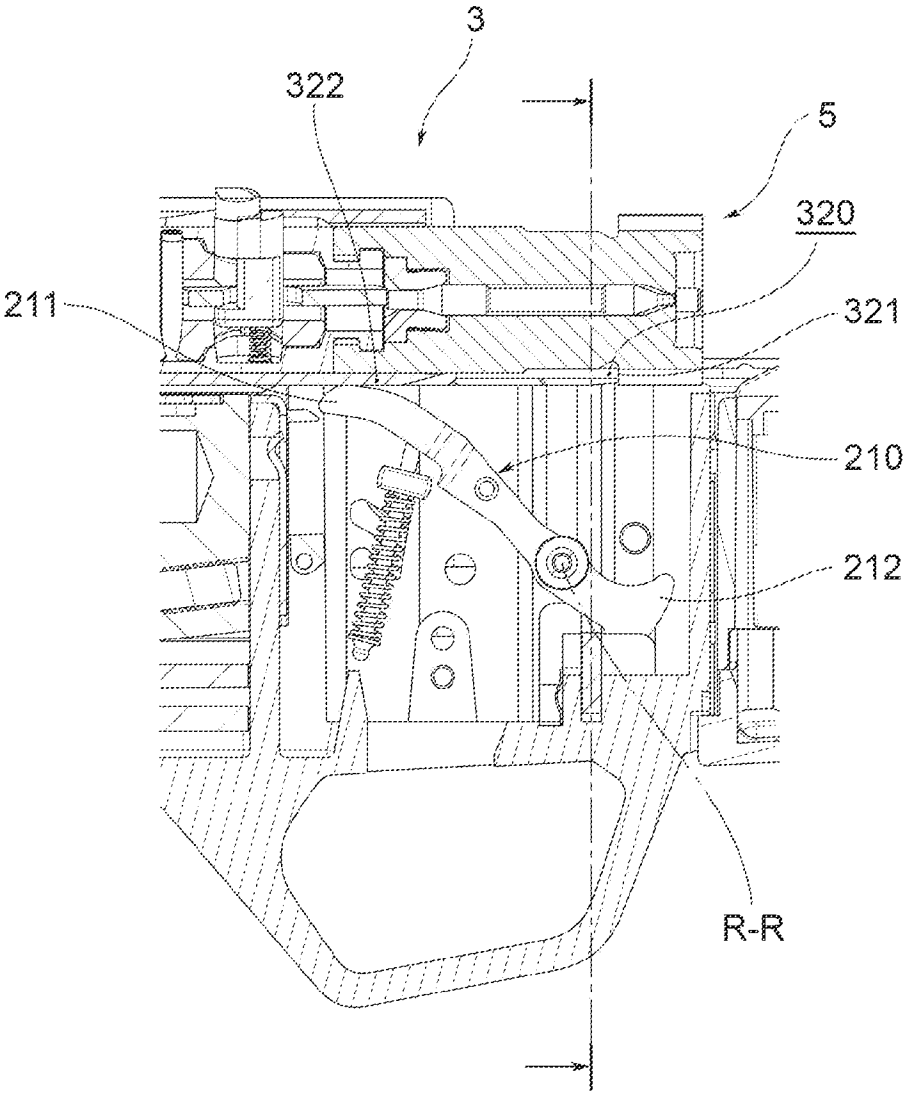
Figure 4:
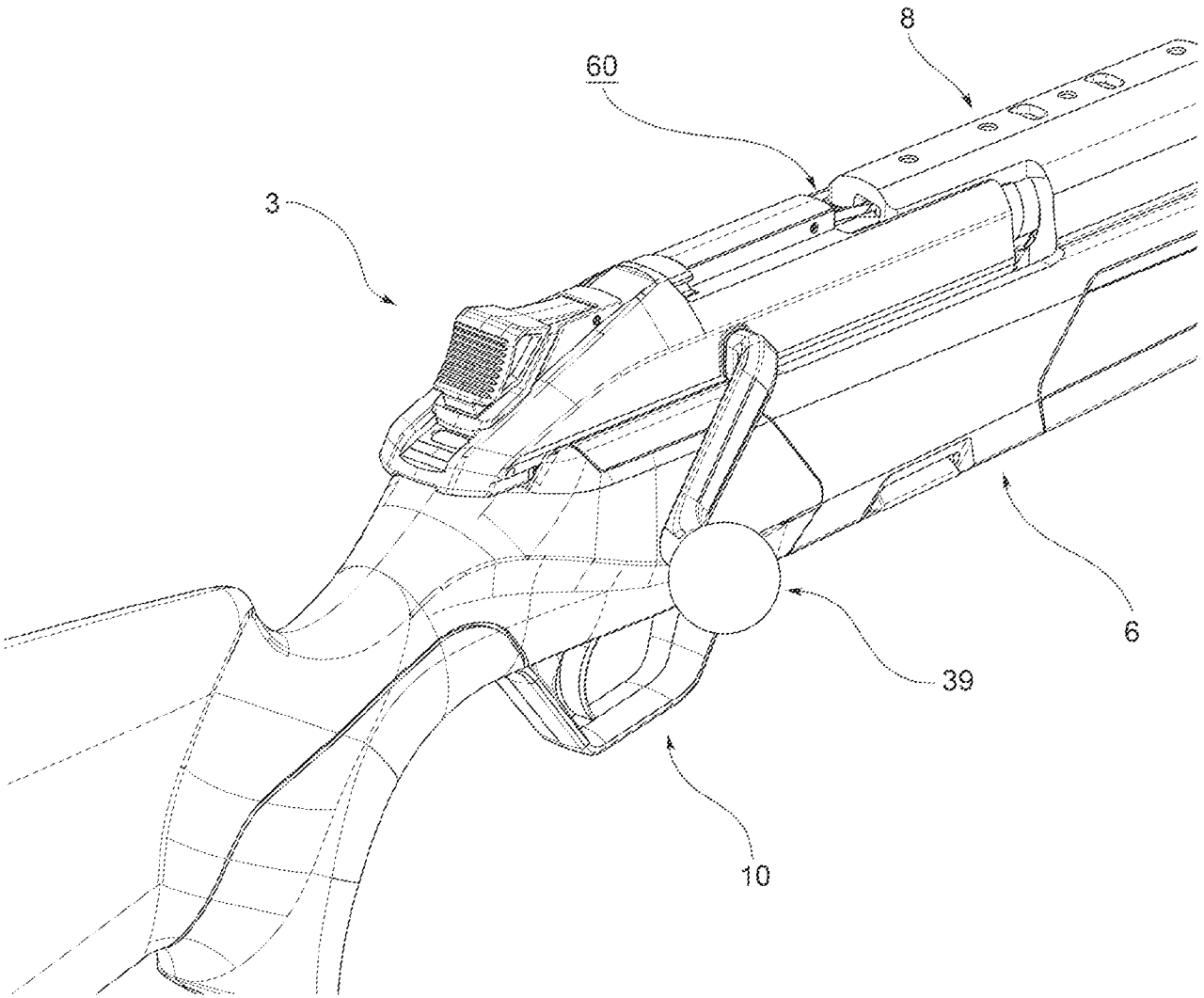
FIG. 4 shows a partial perspective view of the rifle wherein the slide assembly is in a first intermediate advanced configuration.
Figure 4B:
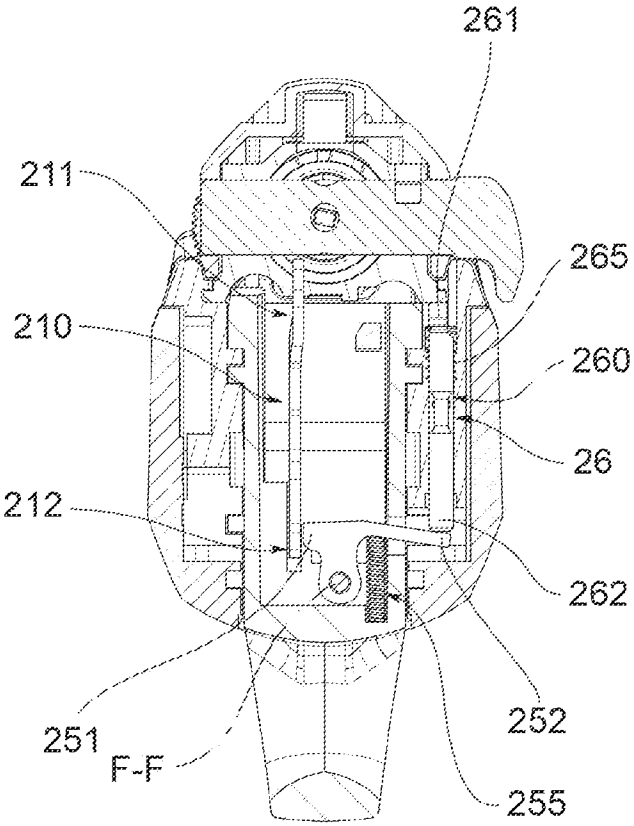
FIGS. 4*a* and 4*b* are two longitudinal sectional and cross-sectional views, respectively, of the rifle of FIG. 4.
Figure 4A:
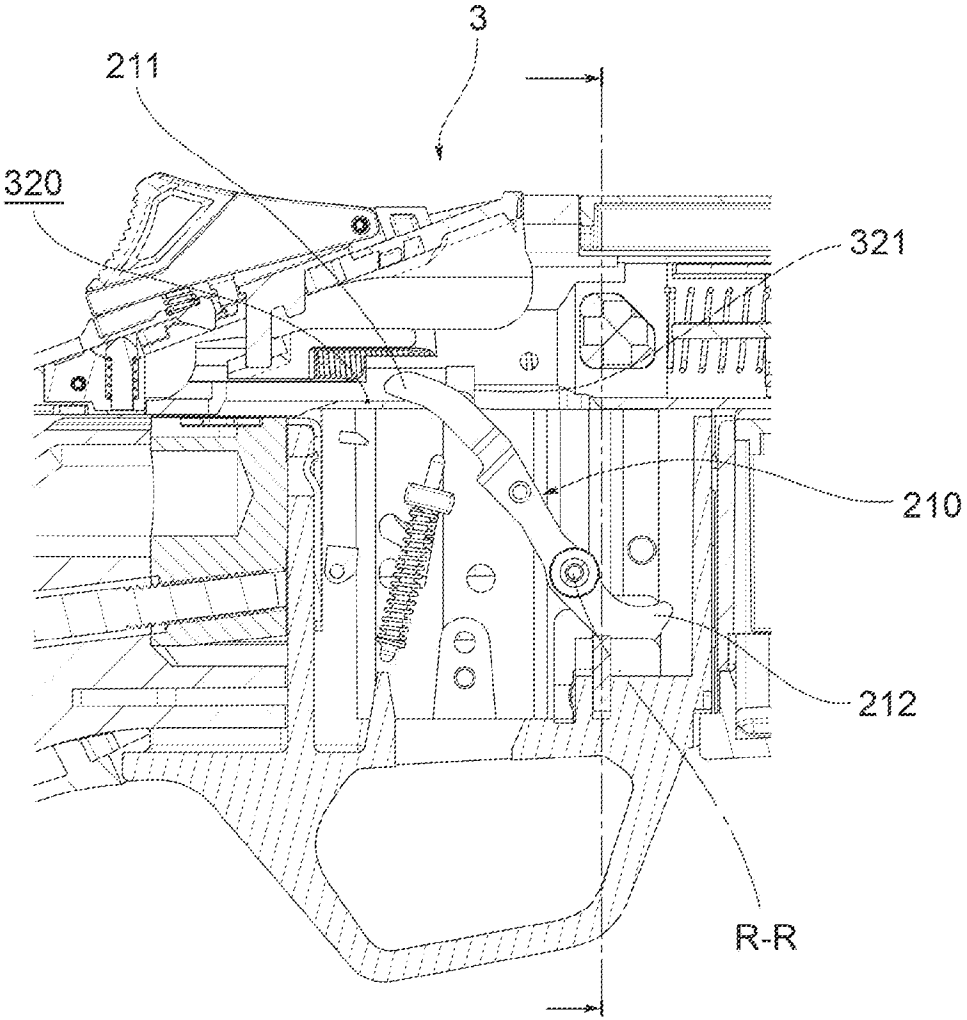
Figure 5:
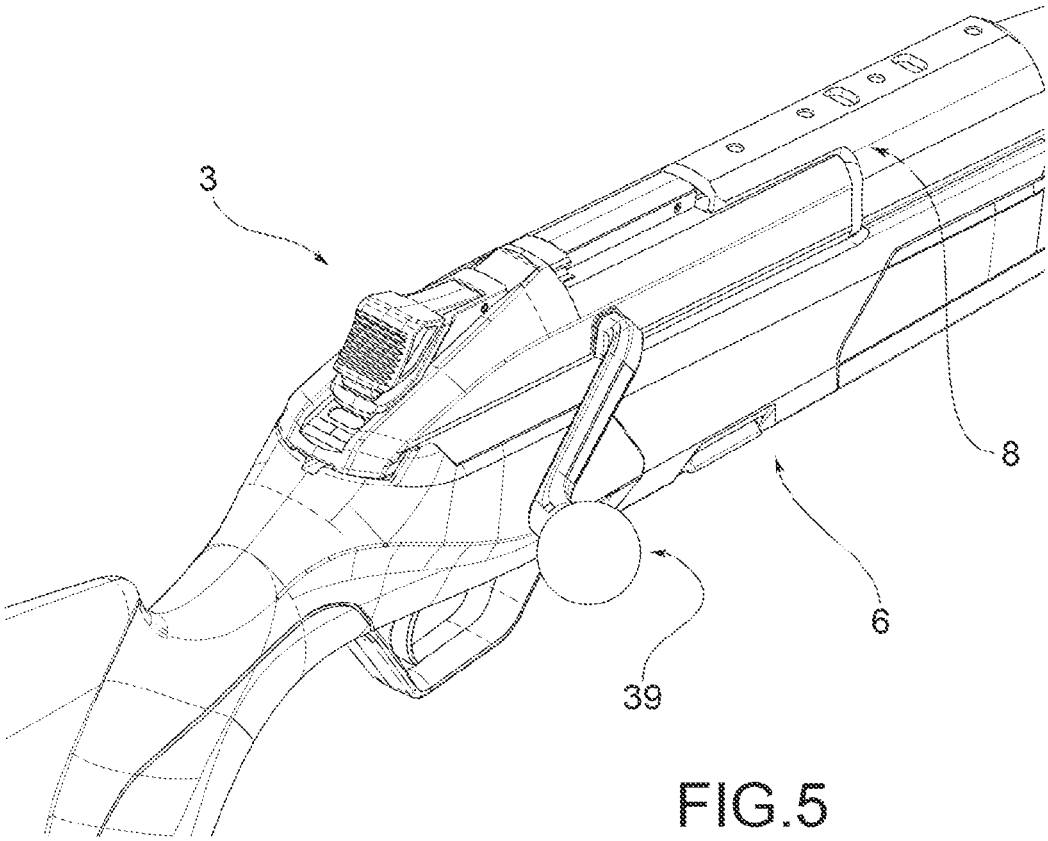
FIG. 5 shows a partial perspective view of the rifle wherein the slide assembly is in a second intermediate advanced configuration.
Figure 5:
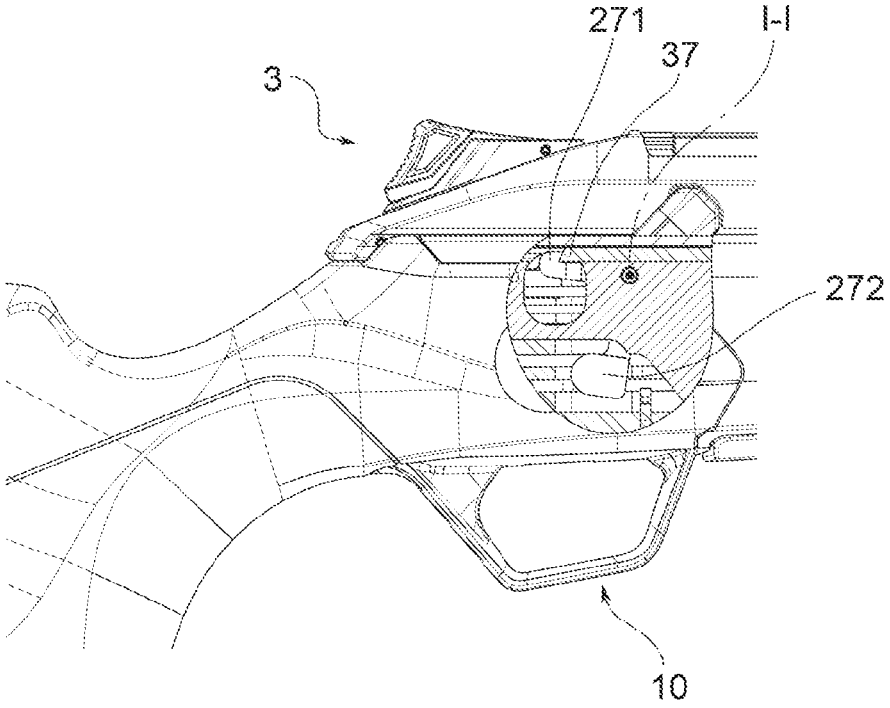
Figure 5B:
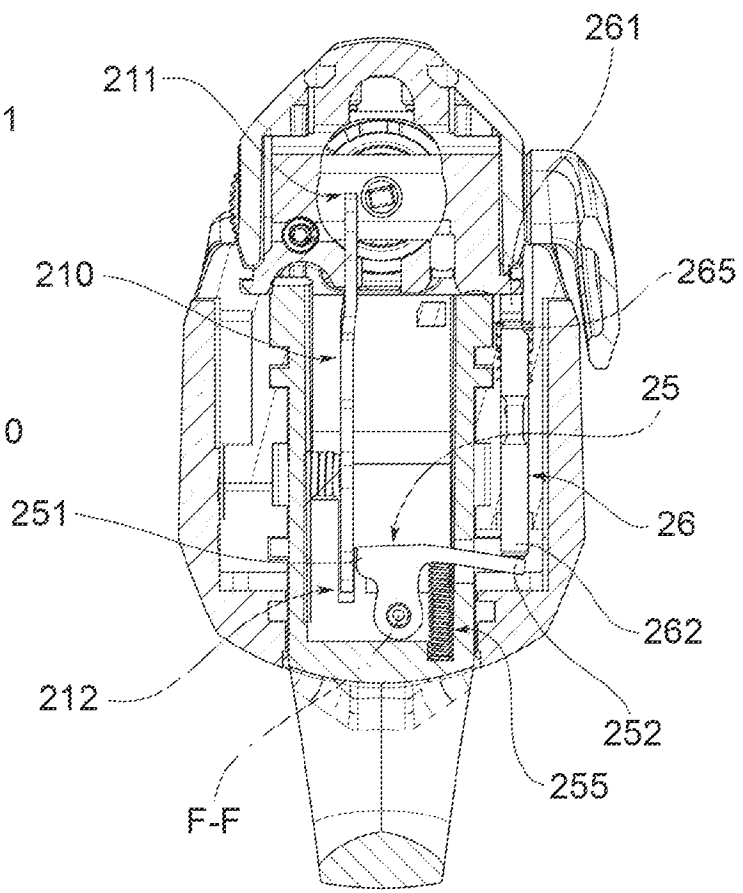
FIGS. 5*a* and 5*b* are two longitudinal sectional and cross-sectional views, respectively, of the rifle of FIG. 5.
Figure 5A:
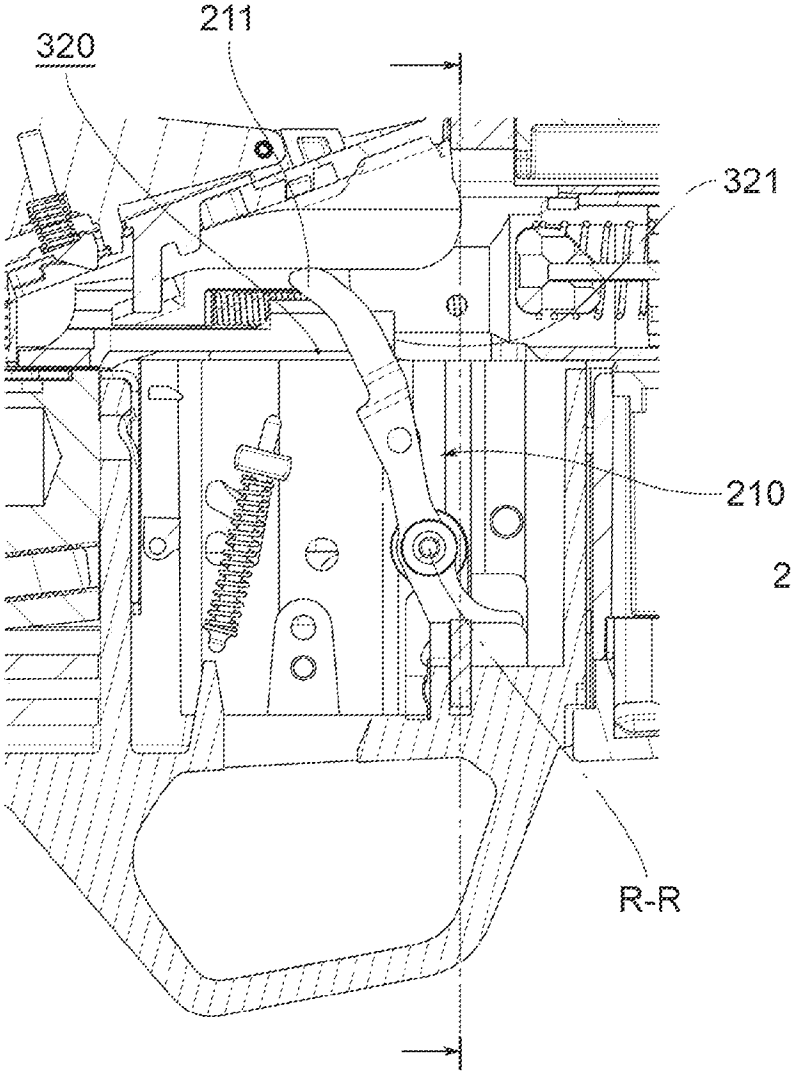
Figure 6:
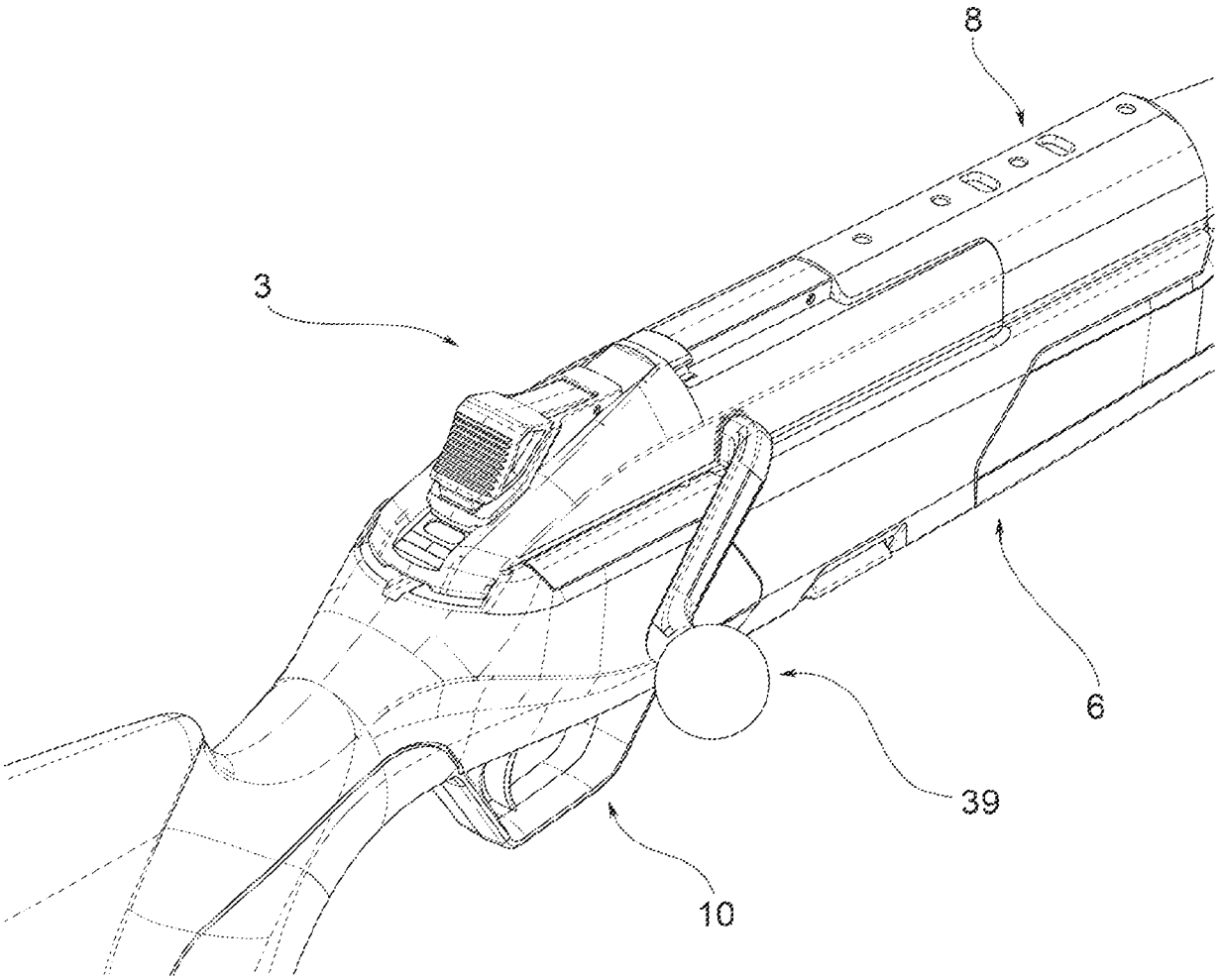
FIG. 6 shows a partial perspective view of the rifle wherein the slide assembly is in an advanced configuration.
Figure 6B:
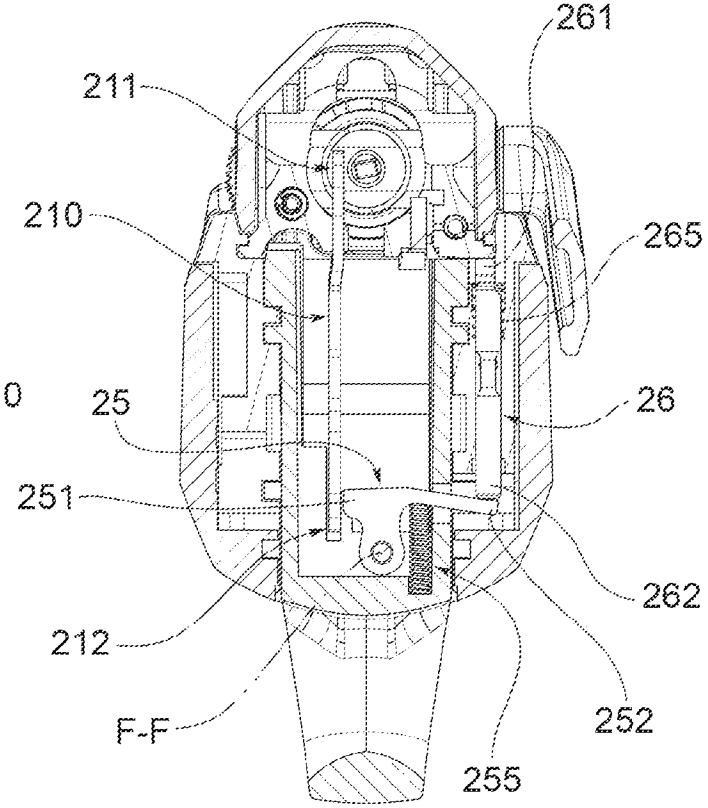
FIGS. 6*a* and 6*b* are two longitudinal sectional and cross-sectional views, respectively, of the rifle of FIG. 6.
Figure 6A:
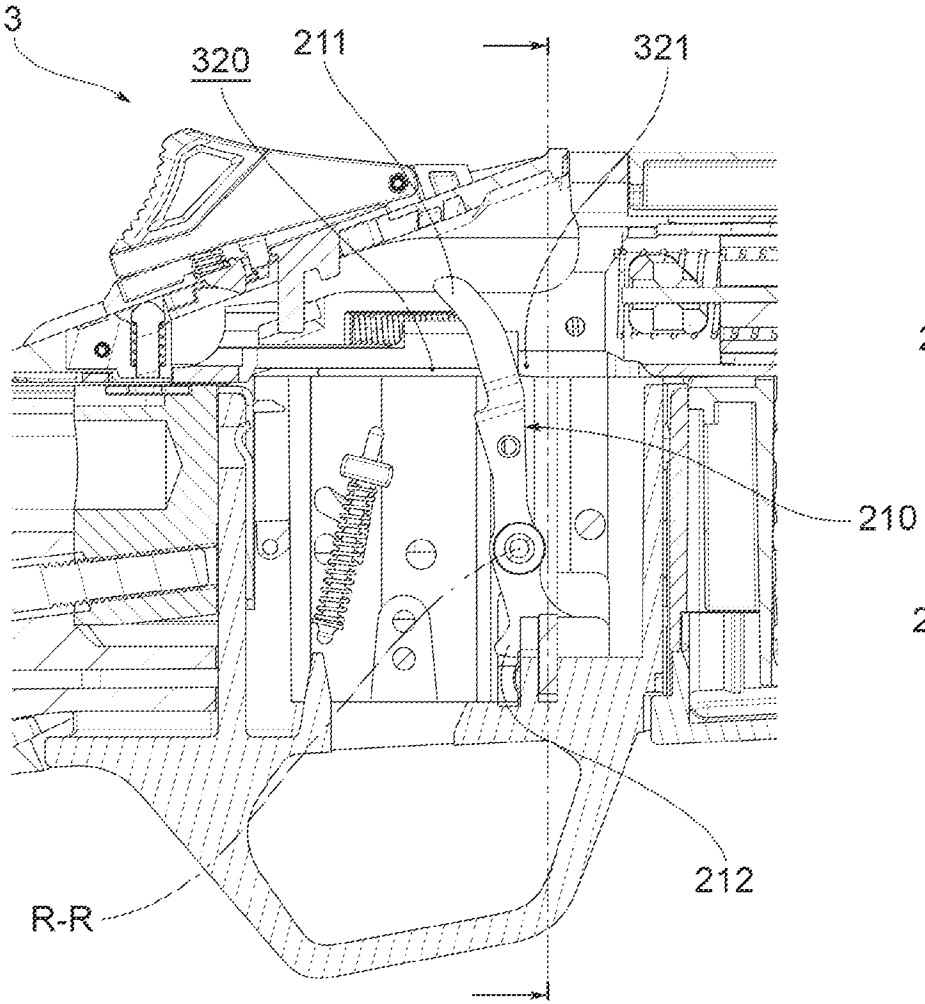

With reference to the accompanying figures, a rifle according to this invention is indicated, in the entirety thereof, with the numeral 1.

The rifle 1 which is the object of the present invention comprises a plurality of components which by convention are defined as fixed, and a plurality of components which are defined as movable.

According to the present invention, the rifle 1 comprises a fixed main body 2.

Such main body 2 is grippable or embraceable by the user, for example in shooting or aiming operations, comprising a stock and/or forend.

According to the present invention, the fixed body 2 comprises a barrel 4 which extends along an axis X-X. The axis X-X is therefore the barrel axis.

Preferably, with reference to movements or certain characteristics or components, "axial" is understood to mean movements or characteristics or components which occur or which are positioned parallel to said axis X-X, i.e. parallel to the barrel 4. In some cases, such movements or characteristics or components are along the barrel axis X-X. Alternatively to the term "axial", the term "longitudinal" is also used.

According to the present invention, the main body 2 comprises a receiver 6.

Preferably, the receiver 6 is made of a material belonging to the family of metals or metal alloys, or polymers, or polymeric materials, or composite materials.

According to the present invention, the receiver 6 has an upper opening 60.

In other words, the receiver 6 has an opening 60 facing the vertical direction.

In still other words, the receiver 6 is a receiver "without a castle".

The receiver 6 is a hollow component suitable for containing components, shooting mechanisms, and bullets.

Preferably, the barrel 4 extends from the receiver 6.

Preferably, the stock extends from the receiver 6.

Preferably, the forend extends from the receiver 6.

Preferably, the receiver 6 also comprises a lower opening 65. The bullets enter through said lower opening 65. Preferably, a magazine 500 is accommodated in the receiver 6. Preferably, the magazine 500 is inserted into the rifle through said lower opening 65. Preferably, the magazine 500 closes said lower opening 65.

According to a preferred embodiment, the main body 2 also comprises a breech element 8 positioned at an axial end of said upper opening 60.

According to a preferred embodiment, the breech element 8 extends in height, preferably in a vertical direction.

Preferably, the barrel 4 is mountable to the breech element 8 at an opposite end from the firing mouth of the barrel 4.

According to a preferred embodiment, the breech element 8 is included in the barrel 4: the breech element 8 is the axial end opposite the firing mouth of the barrel 4.

According to a preferred embodiment, the aforementioned components, listed in a non-limiting manner, that are part of the main body 2 are all mutually distinct components.

According to an embodiment variant, the aforementioned components, listed in a non-limiting manner, that are part of the main body 2 are sometimes mutually integral: some components are mutually integrally connected to each other.

According to the present invention, the rifle 2 comprises a trigger assembly 10 operable by the user to carry out the shooting action.

The trigger assembly 10 is at least partly accommodated in the receiver 6.

Said trigger assembly 10 comprises a trigger 100.

According to a preferred embodiment, the trigger assembly 10 further comprises a hammer device 110 operable by the trigger 100.

According to the present invention, the rifle 1 comprises a slide assembly 3 comprising a shutter group 5.

According to a preferred embodiment, the shutter group 5 also comprises striker members operable by the actuated hammer device 110.

More generally, the slide assembly 3 comprises components, the movements and actuations of which involve a shooting action and a rearming action, i.e. discharging the exploded case to the outside and loading the bullet from the magazine 500.

According to the present invention, the slide assembly 3 is positioned on the receiver 6 at the upper opening 60.

According to a preferred embodiment, the slide assembly 3 is positioned and has a shape suitable for closing said upper opening 60.

Preferably, the slide assembly 3 slides on the axial edges 600 delimiting the upper opening.

According to a preferred embodiment, the slide assembly 3 comprises an assembly body 30 comprising dedicated guides 300 suitable for sliding on said axial edges 600.

According to the present invention, the slide assembly 3 is axially movable by the user between an advanced shooting configuration and a retracted rearming configuration, and vice versa.

Preferably, the slide assembly 3 comprises a rearming handle 39, or rearming trigger, or rearming lever, grippable by the user to perform the aforesaid operations.

According to the present invention, in the advanced or shooting configuration, the shutter group 5 engages the breech element 8, thus completely closing the upper opening 60. In said advanced configuration, the rifle 1 is therefore ready to execute the shooting action, acting with the trigger assembly 10, in particular with the hammer device 110 engaging the shutter group 5, in particular the striker members.

According to the present invention, in the retracted rearming configuration, the slide assembly 3 is positioned so that the upper opening 60 is open. This means that the upper opening 60 is accessible from the top. Preferably, the upper opening 60 is accessible both from the top and from the sides.

In the retracted configuration, the rifle 1 has discharged the cartridge case, and is ready to be brought back to the advanced shooting configuration. In said movement, the slide assembly 3 is therefore suitable for reloading a bullet which may therefore be the object of the shooting action.

According to the present invention, the rifle 1 comprises a recoil group 20 at least partially accommodated in the receiver 6 suitable for cooperating with the slide assembly 3.

Preferably, the recoil group 20 is suitable for performing a thrust action on the slide assembly 3 to push it, carry it and keep it in the advanced configuration.

According to a preferred embodiment, the thrust device 21 comprises a thrust lever 210 suitable for carrying out a thrust action in the axial direction on the slide assembly 3.

According to a preferred embodiment, the thrust lever 210 is rotationally movable around a lever axis R-R which extends substantially transversely.

Furthermore, the thrust device 21 comprises a thrust spring 215 which performs a torsional action on the thrust lever 210.

According to the invention, the thrust lever 210 extends between a lever upper end 211 and a lever lower end 212.

Said lever upper end 211 is suitable for engaging the advancing slide assembly 30 to push it into the advanced configuration.

In other words, the lever upper end 211, for thrust, is suitable for engaging it in certain axial positions of the slide assembly 3 and for discharging the action of the thrust spring 215 thereon by pushing it axially.

According to a preferred embodiment, in the retracted configuration, the slide assembly 3 engages the thrust lever 210, pushing it into a retracted position.

In other words, in the retracted configuration, the slide assembly 3 keeps the thrust lever 210 pressed downwards.

According to a preferred embodiment, the slide assembly 3 comprises an assembly body 30 suitable for interacting with the thrust lever 210.

Preferably, the assembly body 30 comprises a housing cavity 320 facing the receiver 6.

According to a preferred embodiment, the thrust lever 210 is suitable for operating with the assembly body 30, finding accommodation in said cavity 320. Preferably, the lever upper end 211 is suitable for being accommodated in said cavity 320.

According to a preferred embodiment, the cavity 320 is delimited by cavity edges 321, 322 and the thrust lever 210, and in particular the lever upper end 211 thereof, thrust engages a cavity edge 321.

Preferably, the cavity edges 321, 322 are a front cavity edge 321, proximal to the breech element 8, and a rear cavity edge 322, distal from the breech 8, respectively.

According to a preferred embodiment, the front cavity edge 321 is thrust engageable by the lever upper end 211.

Preferably, the front cavity edge 321 is shaped to facilitate the lever upper end 211 resting thereon.

According to a preferred embodiment, the rear cavity edge 322 is specially shaped to allow the lever upper end 211 to slide.

Preferably, said housing cavity 320 is positioned axially distally from the breech element 8.

According to a preferred embodiment, in the advancement operations of the slide assembly 3, the recoil group 20 is suitable for engaging the slide assembly 3 in an axial position of the latter proximal to the breech element 8, preferably at a distance which is less than 20 mm from the breech element 8, preferably 15 mm from the breech element 8.

Preferably, a final advancement stretch is identified, wherein the slide assembly 3 is proximal to the breech element 8, and wherein said recoil group 20 is therefore suitable for acting in thrust on the assembly body 30.

According to a preferred embodiment, the recoil group 20 is positioned and the respective components are designed to act only in said final advancement stretch of the slide assembly 3.

Preferably, the aforesaid described levers cooperate with the slide assembly 3 in such a way as to perform the axial thrust action in said final stretch, assisting the manual action of the user and assisting the positioning of the slide assembly 3 in the advanced shooting configuration.

According to a preferred embodiment, the recoil group 20 comprises a stop member 25 operatively connected to the thrust lever 210 to keep the thrust lever 210 in a retracted position.

According to a preferred embodiment, the stop member 25 is suitable for engaging the lever lower end 212.

According to a preferred embodiment, said stop member 25 is adapted to keep the thrust lever 210 in the retracted position also, and sometimes particularly, with the slide assembly 3 disassembled from the receiver 6.

Preferably, the thrust lever 210 operates only in the presence of the slide assembly 3 which is mounted to the receiver 6 and moved axially towards the advanced configuration.

According to a preferred embodiment, the stop member 25 comprises a stop lever 250 rotationally movable around a stop axis F-F.

Preferably, the stop axis F-F has an extension substantially parallel to the barrel axis X-X.

According to a preferred embodiment, the stop lever 250 comprises a first stop end 251 suitable for engaging the thrust lever 210 and a second stop end 252.

Preferably, the stop member 25 comprises a stop spring 255 suitable for performing a thrust action on the stop lever 251.

Preferably, said stop spring 255 is an axial thrust spring.

According to a preferred embodiment, the recoil group 20 further comprises a connecting device 26 for connecting the stop member 25 and the slide assembly 3.

Preferably, by means of the connecting device 26, the slide assembly 3 influences the position and the condition of the stop member 25.

According to a preferred embodiment, the connecting device 26 is suitable for engaging the stop member 25 depending on the axial position of the slide assembly 3 to command it into engagement with or disengagement from the thrust lever 210.

Preferably, the presence of the slide assembly 3 influences the position of the connecting device 26 which in turn engages the stop member 25, which is therefore commanded to disengage from the thrust lever 210.

According to a preferred embodiment, the connecting device 26 comprises a connecting lever 260 engageable by the slide assembly 3 positionable between a raised position, in which it is disengaged from the stop member 25, and a lowered position, in which it engages the stop member 25, disengaging it from the thrust lever 210.

Preferably, the engagement between the slide assembly 3 and the connecting lever 260 causes the axial thrust and the lowering of the connecting lever 260.

According to a preferred embodiment, the connecting lever 260 comprises a slide engagement end 261 engageable by the slide assembly 3 and a stop engagement end 263 engageable to the stop member 25.

Preferably, the slide engagement end 261 is arched to allow engagement and sliding of the slide assembly 3.

According to a preferred embodiment, the connecting device 26 comprises a connecting spring 265 which operates on the connecting lever 260 to keep it in the raised position 26.

According to a preferred embodiment, the connecting device 26 is positioned in such a way as to be closer to the breech element 8 than to the housing cavity 320. Preferably, the connecting device 26 acts before the housing cavity 320 is in a position to allow the thrust lever 210 to enter.

According to a preferred embodiment, the rifle 1, further comprises an intercept device 27 housed in the receiver 6 suitable for intercepting the slide assembly 3 in an undesired retraction movement. In particular, an undesired retraction movement occurs when the rifle 1 recoils or shakes.

According to a preferred embodiment, the intercept device 27 is suitable for intercepting the assembly body 30 which is the object of a retraction movement, for example a recoil.

Preferably, the intercept device 27 comprises an intercept lever 270 rotationally movable around a transverse intercept axis I-I.

Preferably, the intercept device 27 also comprises an intercept spring 275 suitable for exerting a thrust action on the intercept lever 270 to keep it in a rest and disengaged position.

Preferably, the intercept spring 275 is a torsional spring.

According to a preferred embodiment, the intercept lever 271 comprises a coupling end 271 and an inertial mass end 272.

According to a preferred embodiment, the intercept lever 272 has the center of gravity thereof unbalanced towards the inertial mass end 272, and is movable in rotation into an intercept position in which it is suitable for intercepting the assembly body 30. In other words, the recoil action and said particular shape of the intercept lever 270 causes a rotation.

Preferably, the coupling end 271 is shaped to couple the slide assembly 3.

Preferably, the assembly body 30 comprises a coupling portion 37.

Preferably the coupling end 271 and the coupling portion 37 are specially shaped to engage each other.

According to a preferred embodiment, the trigger assembly 10 comprises a trigger box 11 which is at least partly removably accommodable in the receiver 6.

According to a preferred embodiment, the trigger box 11 is insertable into the receiver 6 through said lower opening 65.

Preferably, the thrust device 21 is housed in said trigger box 11.

According to a preferred embodiment, the stop member 25 is also partially housed in the trigger box 11.

Preferably, the connecting device 26 and the intercept device 27 are housed on the receiver 6 transversely engaged by a wall of the trigger box 11.

The above-described movements and actuations of the various components, as well as the order of the accompanying drawings, are such as to describe the axial advancement actions of the slide assembly 3. On the contrary, the same procedures take place in the retraction operations.

Innovatively, the rifle which is the object of the present invention amply fulfills the intended purpose.

Advantageously, the rifle which is the object of the present invention is an alternative solution to the known ones.

Advantageously, the rifle which is the object of the present invention comprises a recoil group specifically suitable for operating with the slide assembly to bring it into the advanced shooting configuration.

Advantageously, the rifle comprises, in the entirety thereof, the various components of the recoil group housed in the fixed main body, and only specific portions and/or ends of some levers act with the slide assembly.

Advantageously, the action of the recoil group is discharged in the final advancement stretch of the slide assembly.

Advantageously, the cleaning operations of the rifle are extremely simplified. Advantageously, in the configuration with the retracted slide assembly, there is ample access to the upper opening.

Advantageously, the thrust lever is commanded into a lowered position in such a way as to facilitate, simplify, and make the operations for disassembling the slide assembly from the receiver easier.

Advantageously, by mounting the slide assembly on the receiver, the recoil group engaged by the slide assembly commands into a position which is operationally ready to push the thrust lever.

Advantageously, the recoil group also comprises a dedicated intercept device suitable for preventing undesired axial sliding, for example following a recoil action, of the assembly body.

Advantageously, the intercept device is housed in the receiver, discharging the recoil action thereon.

It is clear that a person skilled in the art may make changes to the invention described above in order to meet incidental needs, which changes all fall within the scope of protection as defined in the following claims.

The invention claimed is:

1. A rifle comprising:

i) a fixed main body, fixed, comprising a barrel which extends along an axis, a receiver comprising an upper opening, and a breech element positioned at an axial end of said upper opening;

ii) a trigger assembly at least partly accommodated in the receiver;

iii) a slide assembly comprising a shutter group, positioned on the receiver at the upper opening and axially movable by a user between an advanced shooting configuration, in which the shutter group engages the breech element, and a retracted rearming configuration, in which the upper opening is open, and vice versa;

iii) a recoil group at least partially accommodated in the receiver, configured for cooperating with the slide assembly comprising a thrust device comprising a thrust lever which is rotationally movable around a lever axis, which extends substantially transversely and a thrust spring which performs a torsional action on the thrust lever;

wherein the thrust lever extends between a lever upper end and a lever lower end, wherein the lever upper end is configured for engaging the advancing slide assembly to push the slide assembly into the advanced configuration.

2. The rifle according to claim 1, wherein in the retracted configuration, the slide assembly engages the thrust lever, pushing the thrust lever into a retracted position.

3. The rifle according to claim 1, wherein the slide assembly comprises an assembly body comprising a housing cavity facing the receiver, delimited by cavity edges, wherein the thrust lever, and the lever upper end is configured for operating with the assembly body being housed in said cavity by thrust engaging a cavity edge.

4. The rifle according to claim 3, wherein said housing cavity is positioned axially distal from the breech element.

5. The rifle according to claim 1, wherein in advancement operations of the slide assembly, the recoil group is configured for engaging the slide assembly in an axial position of the slide assembly proximal to the breech element.

6. The rifle according to claim 1, wherein the recoil group comprises a stop member operatively connected to the thrust lever to engage the lever lower end and keep the thrust lever in a retracted position.

7. The rifle according to claim 6, wherein the stop member comprises a stop lever which is rotationally movable around a stop axis having extension which is substantially parallel to the barrel axis comprising a first stop end configured for engaging the thrust lever and a second stop end, wherein the stop member comprises a stop spring configured for performing a thrust action on the stop lever.

8. The rifle according to claim 6, wherein the recoil group further comprises a connecting device for connecting the stop member and the slide assembly, wherein said connecting device engaged by the slide assembly engages the stop member by controlling the stop member to disengage from the thrust lever.

9. The rifle according to claim 8, wherein the connecting device comprises a connecting lever positionable between a raised position, in which the connecting lever is disengaged from the stop member, and a lowered position, in which the connecting lever engages the stop member, disengaging the stop member from the thrust lever, in which the slide assembly is configured for engaging said connecting lever to press the connecting lever into the lowered position.

10. The rifle according to claim 9, wherein the connecting device comprises a connecting spring which operates on the connecting lever to keep the connecting lever in the raised position.

11. The rifle according to claim 1, wherein the recoil group comprises an intercept device housed in the receiver configured for intercepting the assembly body subjected to a retraction movement, for example recoil.

12. The rifle according to claim 11, wherein the intercept lever is rotationally movable around a transverse intercept axis comprising a coupling end and an inertial mass end, wherein the intercept lever has a center of gravity unbalanced towards the inertial mass end and is rotatably movable into an intercept position in which the intercept lever is configured for intercepting the assembly body.

13. The rifle according to claim 12, wherein the intercept device comprises an intercept spring configured for exerting a thrust action on the intercept lever to keep the intercept lever in a rest and disengaged position.

14. The rifle according to claim 1, wherein the intercept lever comprises a coupling end and the assembly body comprises a coupling portion, wherein the coupling end is shaped to engage the coupling portion.

15. The rifle according to claim 1, wherein the trigger assembly comprises a trigger box which is at least partly removably accommodable in the receiver.

16. The rifle according to claim 15, wherein the receiver comprises a lower opening, in which the rifle comprises a magazine insertable into the lower opening, wherein the trigger box is insertable into the receiver through said lower opening.

17. The rifle according to claim 1, wherein in advancement operations of the slide assembly, the recoil group is configured for engaging the slide assembly in an axial position of the slide assembly proximal to the breech element, at a distance which is less than 20 mm from the breech element.

18. The rifle according to claim 1, wherein in advancement operations of the slide assembly, the recoil group is configured for engaging the slide assembly in an axial position of the slide assembly proximal to the breech element, preferably at a distance which is less than 15 mm from the breech element.

19. The rifle according to claim 1, wherein the recoil group comprises an intercept device housed in the receiver configured for intercepting the assembly body subjected to recoil.

* * * * *